US012644284B1

(12) United States Patent
Seeley

(10) Patent No.: US 12,644,284 B1
(45) Date of Patent: Jun. 2, 2026

(54) LOAD TRANSFER SYSTEM

(71) Applicant: Theo Robert Seeley, Hacienda Heights, CA (US)

(72) Inventor: Theo Robert Seeley, Hacienda Heights, CA (US)

( * ) Notice: Subject to any disclaimer, the term of this patent is extended or adjusted under 35 U.S.C. 154(b) by 229 days.

(21) Appl. No.: 18/364,376

(22) Filed: Aug. 2, 2023

Related U.S. Application Data

(63) Continuation-in-part of application No. 17/505,645, filed on Oct. 20, 2021, now abandoned.

(51) Int. Cl.
*E02D 5/22* (2006.01)
*E04C 5/07* (2006.01)
*E04C 5/20* (2006.01)

(52) U.S. Cl.
CPC ..... *E04C 5/073* (2013.01); *E02D 5/22* (2013.01); *E04C 5/20* (2013.01)

(58) Field of Classification Search
CPC .... E02D 5/46; E02D 5/50; E02D 5/60; E02D 5/30; E02D 5/28; E02D 2250/0023; E02D 15/04
See application file for complete search history.

(56) References Cited

U.S. PATENT DOCUMENTS 1,041,035 A * 10/1912 Cummings ..... E02D 5/30 405/256
3,975,917 A * 8/1976 Asayama ..... E02D 5/54 405/232
4,239,419 A * 12/1980 Gillen, Jr. ..... E02D 5/56 405/253
4,588,327 A * 5/1986 Lin ..... E02D 5/30 405/244
4,708,530 A * 11/1987 Faber ..... E02D 7/22 405/253
4,911,581 A * 3/1990 Mauch ..... E02D 5/56 173/183
5,472,296 A * 12/1995 von Allmen ..... E02D 5/80 405/259.5
5,599,599 A * 2/1997 Mirmiran ..... E04C 5/07 428/36.3
7,445,405 B2 * 11/2008 Yurkevich ..... E04C 3/34 405/257
10,501,905 B2 * 12/2019 Han ..... E02D 3/12
2003/0143038 A1 * 7/2003 Babcock ..... E02D 5/808 52/153

(Continued)

*Primary Examiner* — Carib A Oquendo

(57) ABSTRACT

A new two-step construction method for foundations or any structure using steel rebar by covering said rebar with cured concrete or welding smaller rebar to the main rebar prior to being placed into service. This is to obtain advantages over common construction methods by changing the construction sequence and making an efficient system for load transfer. This is done by forming undulating steel bars or concrete on the load bearing rebar prior to placing into service. These can be inserted into borings, trenches, or forms along with granular fill and grout pipes to build designed structures. The grout can be injected at the time of installation, or at a later time. The grout could be additional Portland cement concrete or lower strength grout to complete the structure. The primary advantage is to have full strength steel and concrete in a structure without waiting for the concrete to cure.

7 Claims, 16 Drawing Sheets

(56) References Cited

U.S. PATENT DOCUMENTS

2012/0184649 A1* 7/2012 Iwamoto ..... C04B 28/02
427/388.2
2015/0354162 A1* 12/2015 Bonomi ..... E02D 29/045
52/741.15

* cited by examiner

LOAD TRANSFER SYSTEM

CROSS-REFERENCE TO RELATED APPLICATION

This application claims the benefit of U.S. Provisional Application 63/204,672 Filed on Oct. 19, 2020 and U.S. Provisional Application 63/234,687 Filed on Aug. 18, 2021 which are hereby incorporated into this Patent Application.

Please note that this is a Continuation In Part of my Nonprovisional application Ser. No. 17/505,645 and as such it does contain new additions to those specifications and additional Figures have been added, these changes have been made to improve the usefulness and clarity of the ideas presented herein. This is a resubmittal of the specifications submitted Aug. 2, 2023 and it should be noted that NO new matter has been added.

STATEMENT REGARDING FEDERALLY SPONSORED RESEARCH OR DEVELOPMENT

Not Applicable

THE NAMES OF PARTIES TO A JOINT RESEARCH AGREEMENT

Not Applicable

INCORPORATION-BY-REFERENCE OF MATERIAL SUBMITTED ON A READ-ONLY OPTICAL DISC, AS A TEXT FILE OR AN XML FILE VIA THE PATENT ELECTRONIC SYSTEM

Not Applicable

STATEMENT REGARDING PRIOR DISCLOSURES BY THE INVENTOR OR A JOINT INVENTOR

Not Applicable

BACKGROUND OF THE INVENTION

Field of the Invention (1) This disclosure relates generally but not by way of limitation to all types of construction that uses steel reinforcing bars, commonly known as rebar. This disclosure is for a modification to common rebar to allow for flexibility in the construction process. The general concept is to only use high strength concrete only where it is needed and allow that concrete to cure on the rebar prior to being placed into service. The concrete covered rebar are herein referred to as "modified rebar". Given that most of the concrete in a steel reinforced structure is only filler material that transfers load, this allows for other lower strength material that has a faster set time, or economically produced at the construction site to be used in the final structure. The faster set time makes it possible to significantly reduce the time between stages where cure time is a critical factor for a structure that has multiple stages.

(2) Where ground improvement is required steel reinforced piles may be combined with existing grouting systems for the purpose of supporting structures and/or stabilizing soil formations where loads are generated by said structure and/or unstable ground conditions. It is proposed that for these soil conditions to become stable through the efficient and safe transfer of the loads from shallow unstable soil down to stable soil or bedrock formations that can provide the necessary support. One of the many advantages to using concrete modified rebar with grout occurs when the grout is expansive or placed under pressure so that it penetrates the soil beyond the limit of a drilled shaft. When this occurs then the effective pile diameter is larger than drilled shaft size.

Description of Related Art

The review letter dated Oct. 19, 2022 from the USPTO for the Load Transfer System sited seven patents with similar looking designs. For the purposes of brevity these have been organized into three groups according to similar designs.

1. Patent Ser. Nos. 05/472,296 and 08/108,817 both are intended to improve the corrosion protection of the steel used in piles where conditions can be highly corrosive. The patents provide methods for placing plastic liners in the drilled hole along with the steel reinforcing such that when the concrete is poured into the hole there will be concrete inside and outside the protective liner. One of the primary concerns of placing plastic within a concrete pour is that it has the potential to become slip surface between the inside and outside pours. To mitigate this, the patented provided a method to give the plastic an undulating shape. This does not improve the pile-soil interface along the length of the pile.
2. Patent Ser. Nos. 10/854,565 and 12/288,906 both are intended to improve the vertical bearing capacity of Cast In Drill Hole (here in after referred to as CIDH) piles. The CIDH piles typically are of two types. They are either End Bearing which does not consider the contribution of the side friction, or they are friction piles that only rely on the sides of the drill hole and ignore the contribution from bottom of the pile. These two patents provide designs for using both the side friction and the bottom bearing capacity. The proposed methods are similar in that they propose that once the concrete is poured and allowed to harden then grout or additional concrete is pumped under pressure to the bottom of the pile thus providing a firm contact between the pile and the native soil beyond the bottom of the original drilled hole. This does not improve the pile soil interface along the length of the pile.
3. Patent Ser. No. 05/499,784, 11/887,806, and 16/097,929 all provide methods to improve the contact between the drilled hole sides and the concrete pile by making the contact surface undulate. They each use a different method to accomplish this. Patent Ser. No. 05/499,784 uses a driven precast pile with an undulating shape. Patent Ser. No. 11/887,806 uses an elastic membrane such as a rubber bulb and high pressure to deform the sides. Patent Ser. No. 16/097,929 uses a side jetting system to wash out predetermined deformations in the drilled shaft. These last two deform the sides prior to installing the rebar and pouring concrete into the hole. These systems do not improve the soils beyond the limit of the pile.

The patent proposed herein is different from the above referenced patents and it has superior properties. This proposed patent method is intended to improve the contact between different materials so that there is improved transfer of the load to and from the steel and the surrounding ground and at the same time improve said ground's load carrying capacity. This is accomplished by first casting Portland cement concrete in an undulating shape around the rebar and allowing it cure prior to use. This is referred to herein as a modified rebar. Once the modified rebar has cured it is then installed in the larger size drilled hole along with grout pipes, vibratory densification device, and finally backfilled with granular material. The granular fill is then densified in place. When pressure grouted or expansive grout is used it performs two very important functions to improve the transfer of the load between the steel reinforcing and the surrounding soil. First it locks the granular material in place around the concrete covered rebar to form a bond between those two different materials. Second depending upon the grout pressure and the soil conditions the grout will flow out into the soil beyond the limits of the drill hole. This results in a pile with a capacity greater than its drill size would indicate. Therefore, it is important to not leave any casing in the drill hole. The grout needs the maximum opportunity to flow out into the native soil beyond the drilled hole. While also bonding the granular fill into a solid mass.

Giving the pile core is comprised of modified rebar with an undulating concrete shape to improve the load transfer to the lower strength grouted granular fill material. When pressure grouting is used it will make better contact with the native soil that is beyond the disturbed soil layer along the inside of the drilled hole. The first two patents listed under number 1 above only used an undulating shape to prevent internal slippage along the protective plastic within the concrete in the hole. It is necessary for the concrete to be poured inside and outside the plastic liner at the same time to prevent collapse of said liner. The result is a typical CIDH pile with an undulating plastic liner within the concrete to protect the steel from corrosion. There is no improvement to the contact between the concrete and the disturbed soil along the sides of the drill hole.

The second two patents listed under number 2 only grout the bottom of the hole. This only improves the end bearing capacity but it does not affect or improve the friction along the side of the drill hole where the soil has typically been disturbed by the drilling of the hole. Improving the friction contact and thus the efficient transfer of load between the grouted pile and the undisturbed soil beyond the drill hole is one of the primary claims of this patent.

The last three patents are designed to make the outside of the pile have a variable shape to improve the side wall friction along the outside of the pile. The patents listed under number three use predetermined locations for the bulges. The first one uses a driven pile but does not discuss the ground disturbance caused by the larger undulations leaving the smaller sections in contact with highly disturbed soil. The other two patents also place the larger undulations at predetermined locations. The disadvantage to this is that it is common for the soil conditions across a site to vary greatly. Therefore, some piles may have the larger undulation in contact with strong soil and for other piles they may be in contact weak soil layers. This would result in similar piles having very different capacity across a site. Therefore, as proposed here in this is better for the grout to be under pressure and let it seek out the weaker layers and both improve the foundation soil internally and the friction contact along the sides of the pile. The patent proposed herein, intends to tie the pile to the surrounding soil with the grout, and increase the density and strength of any weak layers of soil thus improving the bearing capacity of the weak layers.

The Rapid Pier patent has been reviewed and was covered in the previous submittal for this proposed patent. To be complete, the differences between the two patents are being included herein. The Rapid Pier system does leave the casing in the drill hole along with the grout pipes. The casing is perforated at predetermined locations along its length. When the expansive plastic grout is injected, it is then able to flow out into the annular space between the side of the drill hole and the casing. This allows the grout to also penetrate the native soil beyond the drill hole, thus improving the contact between the pile and the native soil around the pile. The patent does state that gravel and steel rebar could be inserted into the casing, but the figures do not show how this should be done. It does say that the top three feet of the casing should be filled with concrete and rebar, because the expansive grout is only effective when confined.

Although the Rapid Pier system works it is significantly different from the patent proposed herein. First it should be noted that the ribs on steel rebar are designed to work with Portland cement concrete. The load must be transferred to or from the load carrying steel rebar at the ribs. This patent proposes that the rebar first be covered with Portland cement concrete for two purposes. First to protect the rebar from corrosion and second to transfer load to and from the steel rebar using the ribs to transfer load to the surrounding molded concrete. The concrete is then shaped to improve transfer of load to the grouted sand and gravel which will have a lower strength than Portland cement concrete. This is acceptable because the granular fill zone has a larger cross-sectional area. The basic idea is that load carrying capacity is a combination of cross section area and strength per square inch. In other words, the rebar is very small in cross sectional area but high in per square inch strength. The concrete is lower in per square inch strength but covers a larger cross section area. Again, the grouted gravel is not as strong as Portland cement concrete but has a larger cross-sectional area. Therefore, each material has approximately the same total load carrying capacity. This is a superior method of transferring load when compared to injecting expansive plastic against the small ribs on the rebar which are designed to work with higher strength material.

Having the cured concrete precast on to the rebar provides additional options not available to the other methods discussed above. In the case of caving soil where casing is required the modified rebar provides the steel rebar with a minimum concrete cover. Then the backfilling the casing will result in the caving soil being supported continuously as the casing is removed.

BRIEF SUMMARY OF THE INVENTION

The standard method of constructing Cast In Drill Hole (CIDH) piles is as follows: Drill a hole in the ground based upon the projected load and the soil/rock capacity to support the load. If caving of the hole occurs, then install casing or fill the hole with a heavier than water drilling fluid. Next lower into the hole a steel rebar or a group of bars tied together to form a steel reinforcing cage. Finally fill the hole with concrete and possibly remove the casing if it was only used for temporary support of the drilled hole. In the case of drilling fluid it is always displaced by filling the hole from the bottom up with the heaver concrete.

The above method has several inherent weak points that are typically covered by making conservative design requirements. These are;

1. Caving of the surrounding soil/rock when the hole is open this is a common problem. The odds of this happening increases dramatically when the diameter is increased.

2. A disturbed zone around the inside perimeter of the hole. This is from the drilling action against the existing soil. This almost always results in a loss of strength at the critical interface between the soil and the concrete.
3. The hole must be sufficiently larger than the rebar cage to ensure that the rebar will have a minimum cover of concrete to protect it from corrosion.
4. There are also issues with the timing of the concrete placement. The inspection, casing removal, and concrete pour are all performed by different groups all working at the same time. Therefore, scheduling of each pile pour is critical. Once the concrete is mixed there is a definite time limit on its usefulness.
5. In summery one pile requires the timing and close scheduling of several groups. Then if load testing is desired it must wait several weeks for the concrete to cure. Due to the high possibility of problems and the high cost of remedial repair these piles are typically constructed with a significant level of overdesign in the plans to ensure a minimum capacity pile.

Many of the above problems can be eliminated or minimized if the rebar/or threaded bar is first covered with a minimum protective cover of concrete that has an undulating shape. The advantage to the undulating shape is that for its full length the rebar will have protection from corrosion and have the optimum shape needed for transferring load to or from lower strength material. The drilled holes will not require casing once the hole is filled with coated rebar, grout pipe, and sand and gravel filler. The holes can remain in this backfilled state until it is advantages to grout them, such as grouting an entire pile group all in one grout session. When fast setting grout is used, then they can be either load tested, or placed into service shortly after grouting.

For ground stabilization the coated rebar or threaded bar can be installed in drilled holes or trenches along with the necessary grout pipes and granular fill. Once grouted the stabilized soil or rock formation can withstand a significant increase in loading such as having a steep or vertical cut made at the perimeter of the stabilized soil or rock formation. In either case using expansive or pressure grout will extend the zone of load transfer beyond the limit of the initial drilled hole or excavation. Thus, using steel reinforcing that is first coated with concrete that is allowed to cure before its final placement and using grout that expands results in a superior transfer of loads from material that needs support to formations that are inherently stable and can withstand the additional load without detrimental effects.

Where temporary confinement can be developed these same techniques could be used for construction of above ground structures.

BRIEF DESCRIPTION OF VIEWS OF THE DRAWINGS

The attached figures listed here show how this load transfer system will work.

DETAILED DESCRIPTION OF THE INVENTION

Figure 1:
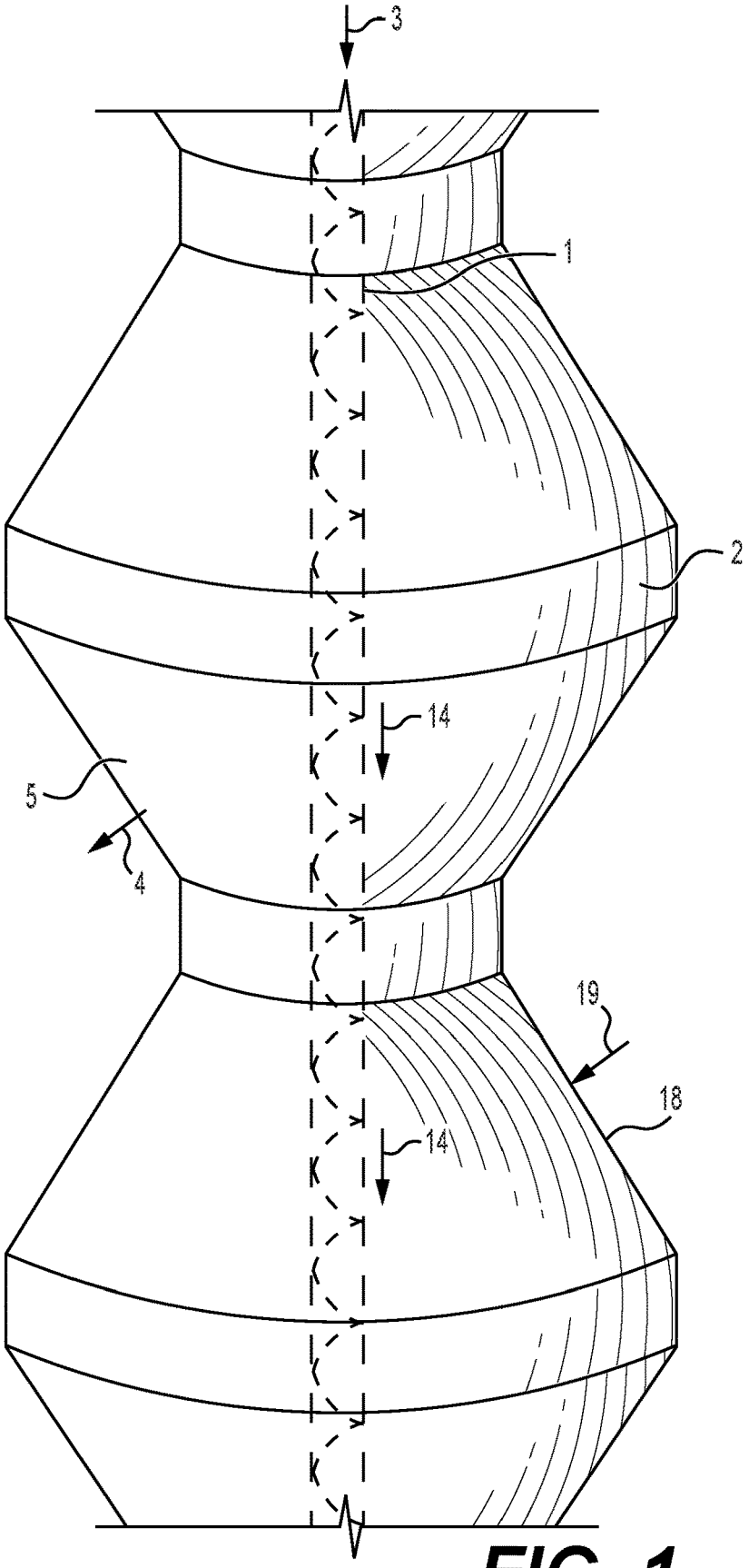
FIG. 1 Shows a perspective drawing of the undulating concrete with a steel rebar within (modified rebar).
Figure 2:
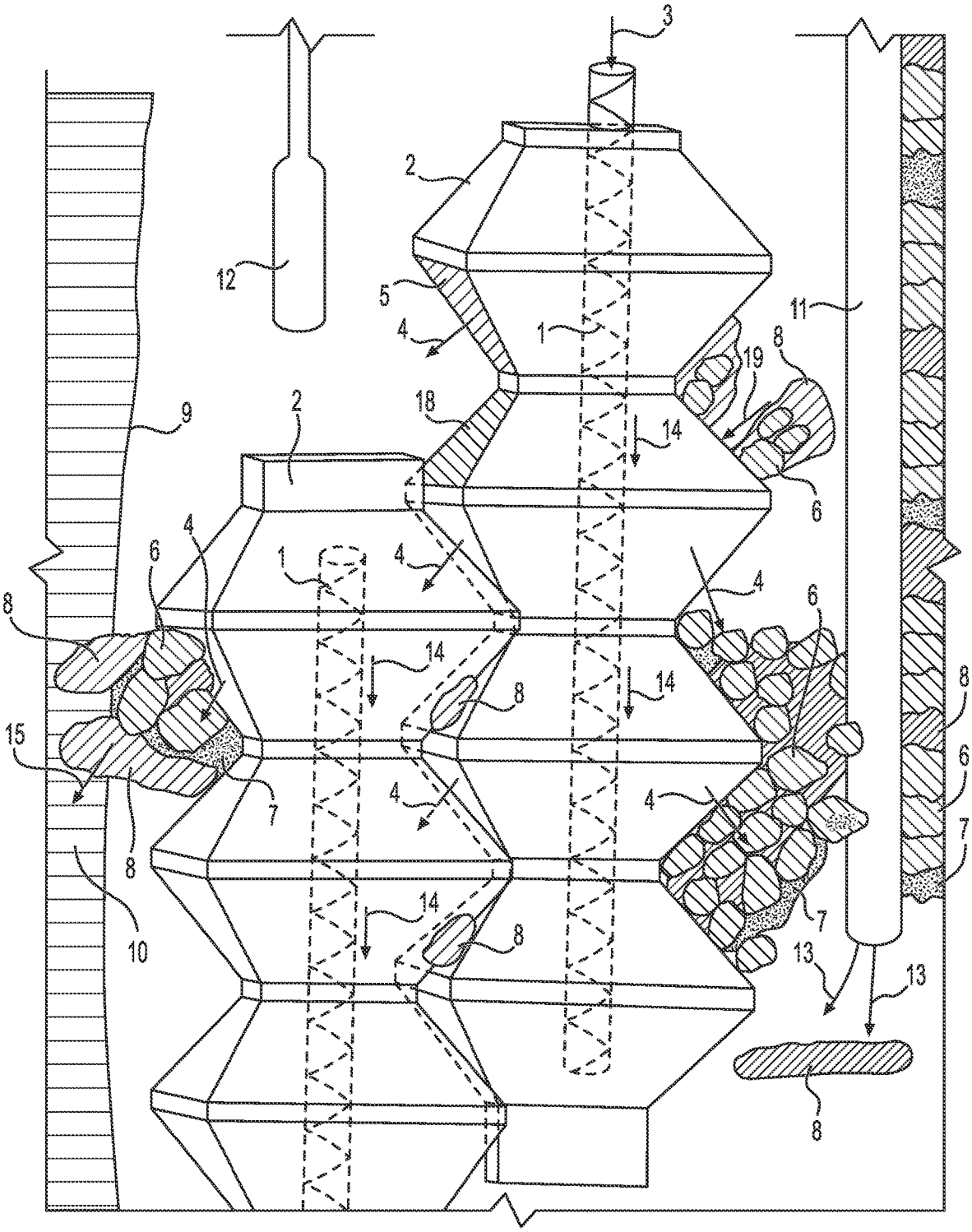
FIG. 2 Cut view of section of pile in hole showing transfer of external load between two modified rebars and ultimately to soil.
Figure 3:
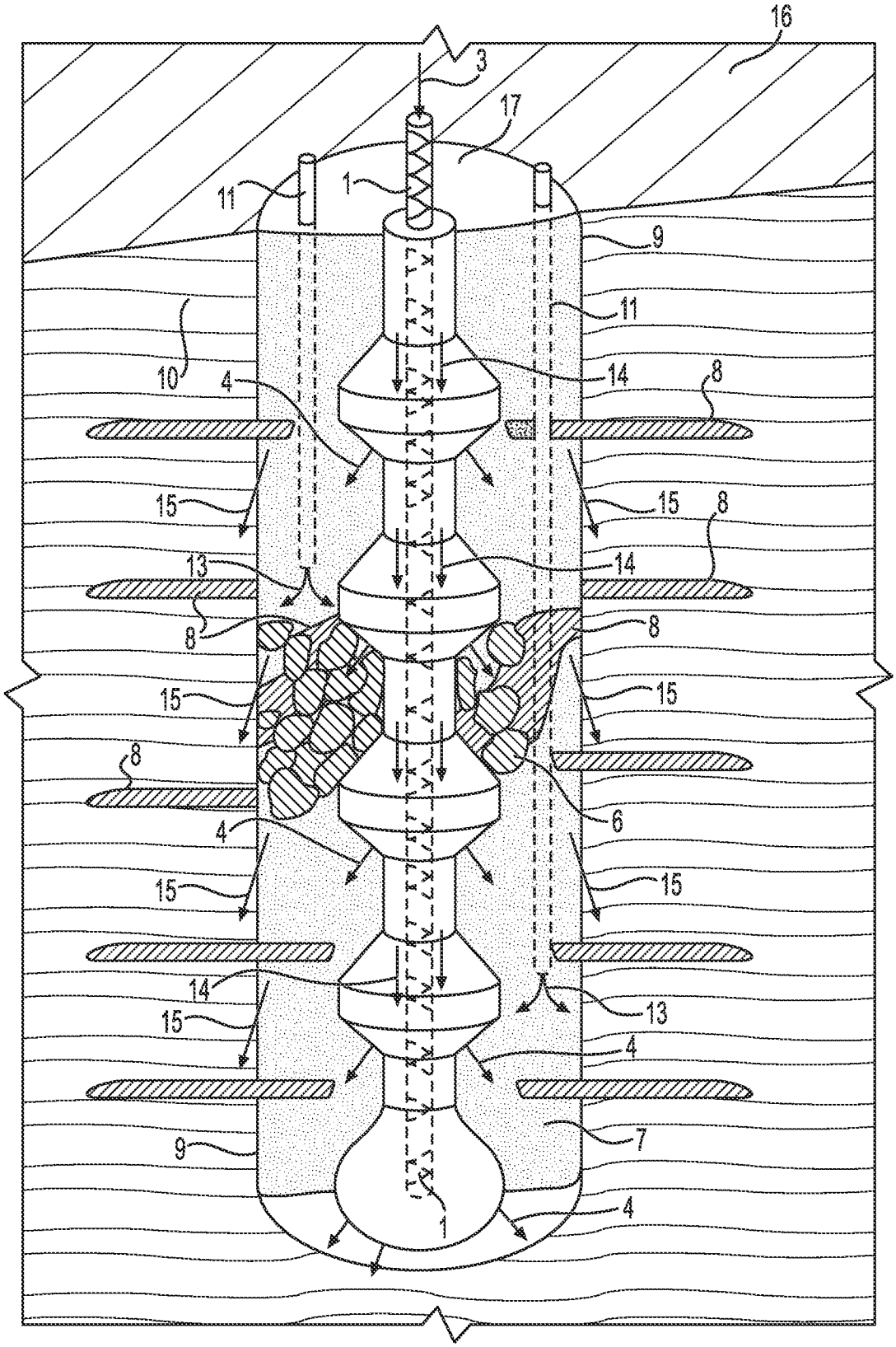
FIG. 3 Cut view of complete pile with modified rebar transferring load to soil both adjacent to the shaft and beyond the drilled hole.

The claim of this patent is if the common order of the CIDH pile construction process is changed many the above listed problems can be eliminated or minimized. The basic idea is to cover the steel rebar with an undulating coating of cured concrete herein after referred to as modified rebar as shown in FIG. 1. This modification is completed prior to placing the rebar into service. This ensures that each rebar has the minimum concrete cover required for corrosion protection. Then corrosion is not a concern when the modified rebar or rebar cage is lowered into the drilled hole, excavation, or larger mold along with the grout/water pipes, granular fill, and vibratory equipment. Once the fill is densified then the vibratory equipment can be removed. Then the fill mass is grouted and it can be placed into service as soon as the grout cures. In the case of a pile foundation this is shown on FIG. 2 where the rebar 1 is shown inside the concrete cover 2 which in turn is inside a bore hole with limits 9. The process in FIG. 2 has reached the grouting phase as demonstrated by the fluid grout 13 flowing out of the grout pipe 11. Prior to grouting the sand 7 and gravel 6 have been saturated by adding water as a lubricant and then densified by using a typical concrete vibrator 12. FIG. 3 presents a section view of a modified rebar 1 in a pile hole that is filled with sand 7 gravel 6 and grout 13. FIG. 3 also shows how the load 3 is transferred from the rebar 1 to the molded concrete 2 through load transfer 14 along the ribs of the rebar. Then the load 4 is transferred from the concrete to the dense sand 7 and gravel 6 that will be permanently locked in place by grout 13. Finally, the load 15 is transferred from the grouted sand 7 and gravel 6 portion of the pile to the grout improved soil 10.

In this process the surrounding soil 10 has been improved where the solidified grout 8 has intruded the weaker zones. Leaving the hole unlined or removing the temporary casing increases the likely hood that the weakest layers in the soil 10 will be improved by allowing the grout to flow freely under pressure. It should be noted that either during or after backfilling the hole and prior to grouting the same pipes 11 can be used to wet the granular material so that the vibratory device 12 can efficiently densify the wet material to ensure that the granular fill has attained its highest possible density. The efficiency of load transfer is dependent upon the density of the granular material used to fill the majority of the drilled hole. This is important for proper load transfer from the concrete that is coating the rebar to the foundation soil 10 beyond the hole. To complete the process liquid grout 13 would then be injected into the hole. Grouting has two purposes; 1) the grout will lock the dense sand 7 and gravel 6 in place to maintain its high-density configuration, and 2) under pressure the grout will flow out into the weaker layers or zones in the surrounding soil 10. Filling the majority of the hole with granular material and grouting changes the interface 9 into a gradual change from one soil type to another. This would greatly improve the contact between the filled drilled hole and the supporting soil 10 formation. Which is the primary limiting factor when determining the pile's capacity. This is typically described as the adhesion factor between dissimilar materials such as soil/steel or soil/concrete.

The ground improvement and grouting industry have developed many grouting materials. This includes what is known as "granddaddy grout". That is a simple mixture of water and Portland cement and possibly fly ash to help it flow. The choice of grout and/or granular fill is not a subject of this patent application. The system proposed herein will work with a wide verity of grouts and granular fill material. The choice of those materials for any given project would depend upon many factors such as desired load capacity, cost, and availability of materials.

It is helpful to look at the basic aspects of how a CIDH pile functions. The Youngs modulus of the steel is so large compared to the concrete, or the modulus of the soil that it virtually carries all the load initially. Moving down the pile the load is transferred to the concrete through the small ribs on the steel bar. Then the concrete ultimately transfers the load to the soil. This compressive load transfer inside the concrete is primarily through the gravel portion of the concrete mix. This is why densification of wet concrete is so important. The individual gravels must be in contact with the adjacent gravels. Then at the foundation soil/concrete interface the load must be transferred from the outer surface of the concrete to the soil which has typically been disturbed by the drilling process. The results in a relatively low rate of load transfer per square unit of surface area along the inside of the drilled hole.

Examination of the load transfer finds that the high strength of the concrete is only utilized at the steel rebar/concrete interface. As the load moves out through the concrete away from the rebar it becomes spread out over a larger and larger cross-sectional area. Thus, the same load is carried by a larger volume of concrete. This results in lower and lower levels of stress per unit of concrete. The end result is that the majority of the concrete is underutilized, and therefore, it is primarily filler material. FIG. 3 again shows that the lower pressure can be carried by sand 7 and gravel 6 zone where they are locked in place by solid grout 8 in a dense configuration. This system will work just as efficiently as a typical fully concrete CIDH pile, and the wait time to place the pile into service is only limited by the grout set time.

For concrete the primary purpose of the sand and cement is to hold the gravel size rock in-place. Therefore, a similar product can be produced by first installing dense sand and gravel and then injecting a cementing or grouting agent under pressure. The primary limitation to this "out of order process" is the high stress level at the rebar to concrete interface where large load transfer per square unit of surface area 14 occurs. The ribs on the rebar are intended to work with wet concrete forming around them. This patent offers the alternative by placing the steel rebar in a mold and pouring concrete around the rebar and allowing it to harden under ideal conditions prior to installing the rebar or rebar cage in the final product. At this point in the process the key to successful load transfer is provided by the shape of the molded concrete. Tests to date indicate that if the concrete is molded in an undulating shape there is very good load transfer between the concrete and the dense sand and gravel material used to finish filling the hole or mold.

It has become obvious that the majority of the concrete in a typical CIDH pile is underutilized. Once the load has been transferred from the steel to the concrete then a lower strength filler material such as dense sand and gravel that is grouted in place will suffice. Therefore, the grouting process results in a superior overall product because it improves the pile to soil contact. Given the variable nature of natural soil formations it is essential that all casing be removed prior to grouting. This is to ensure that the grout will encounter and improve all weak layers along the pile/soil interface.

Figure 4:
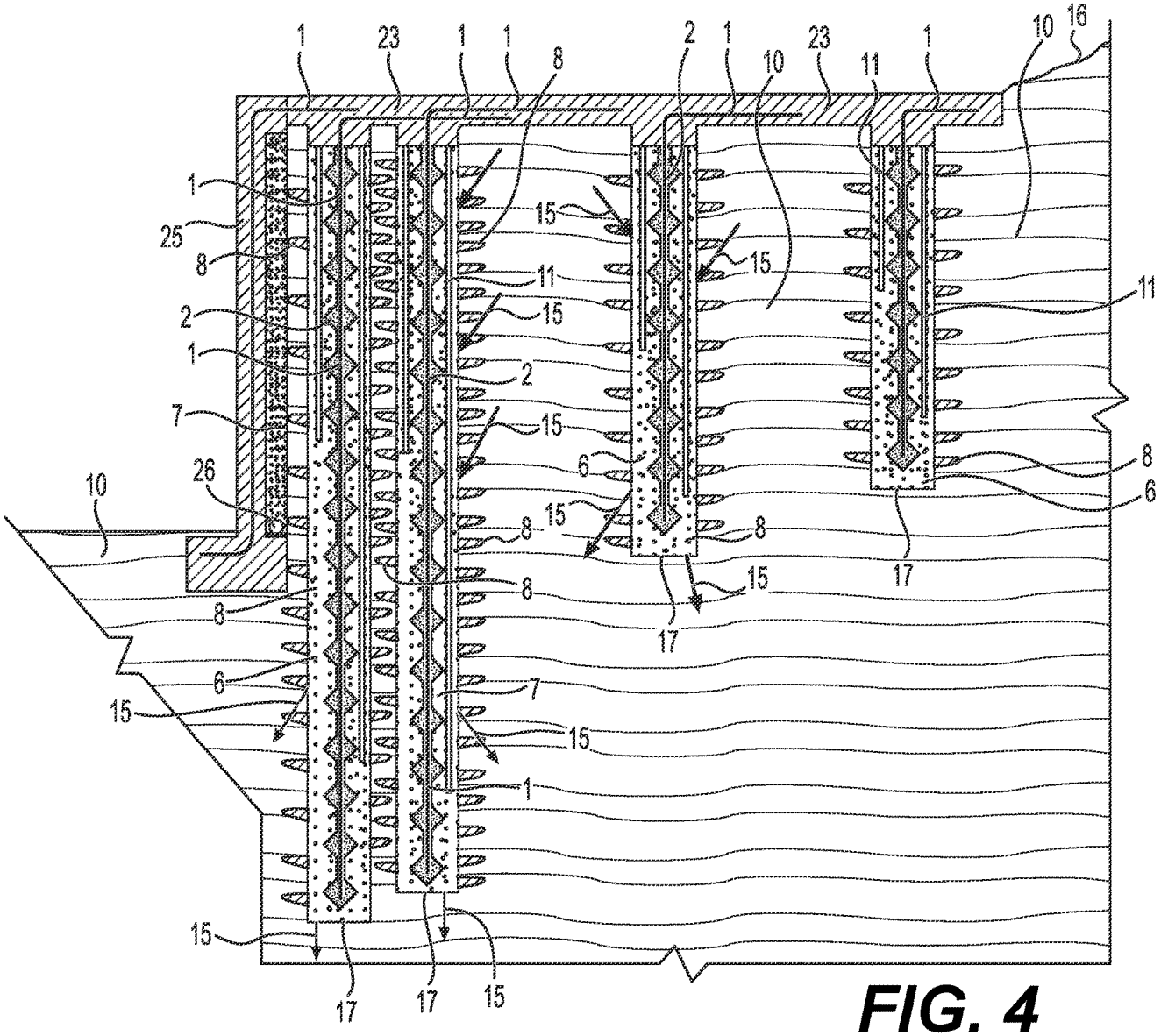
FIG. 4 Cut view of multiple piles using modified rebar to provide internal stabilization of soil mass to reduce the load on a retaining wall.
Figure 5:
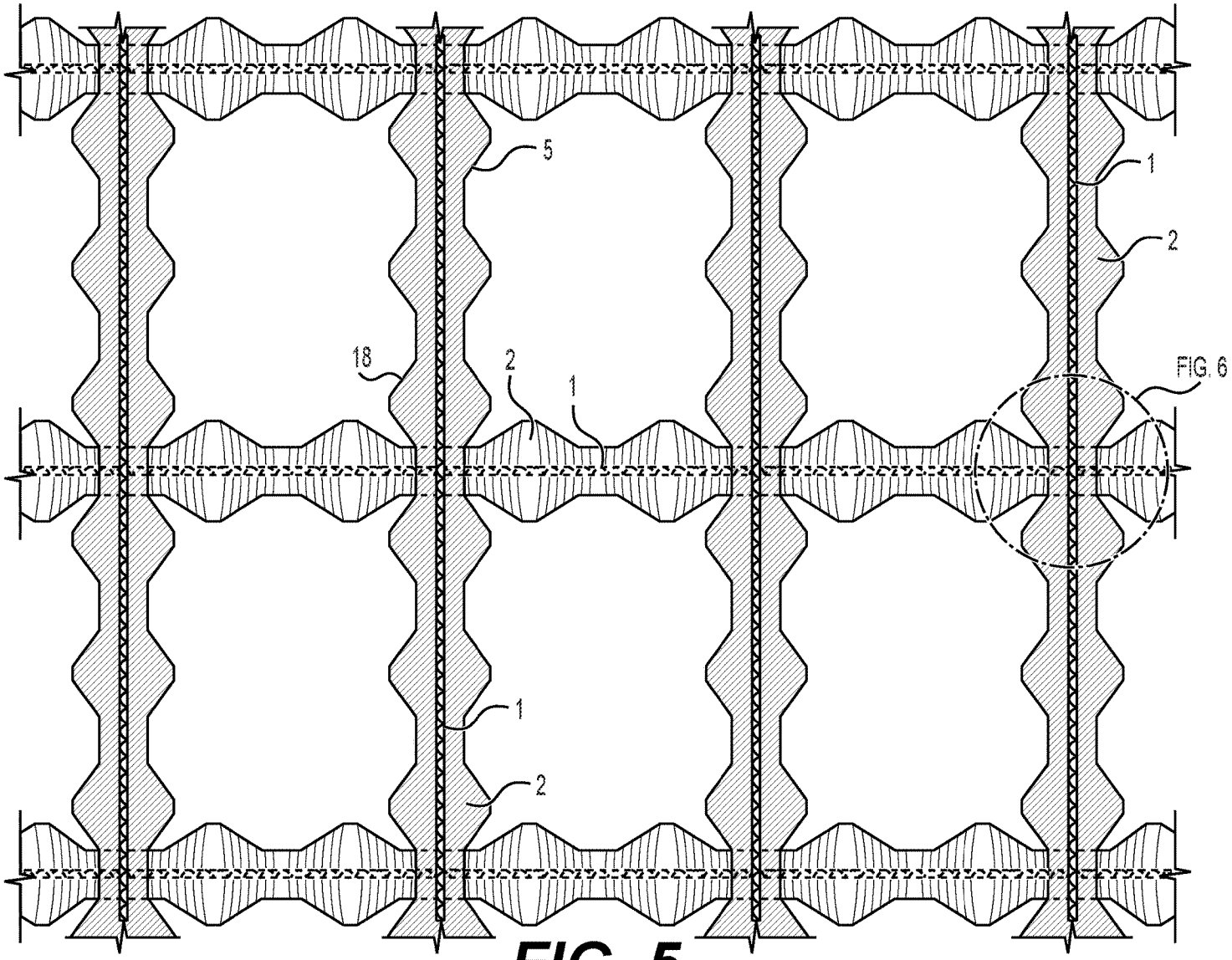
FIG. 5 Shows how multiple modified rebar may be grouped to make a frame system where loads are coming from multiple directions. Also, the location of the detail drawing of the frame which is presented in FIG. 6.

Given the tendency for grout to travel out into the soil beyond the limit of the drilled or excavated hole, this method is superior in a great number of cases. The end result is a pile or buried wall that functions like it is larger than the initial drill or excavated size of the hole. Thus, a small diameter pile could have the same load carrying capacity as a larger diameter pile. FIGS. 3 and 4 present a condition where small diameter piles would have a great advantage over typical CIDH piles. The fact that the grout will extend beyond drilled hole allows for greater spacing between piles. Also, for temporary conditions the molded concrete 2 could be designed to have a threaded shape to accommodate a threaded steel rebar 1. When the excavation has been backfilled, and the steel is no longer needed. If threaded bars are used then they could be unscrewed from the molded concrete. One of the primary claims of this patent is that unstable ground conditions can be stabilized by this method of load transfer using modified steel rebars 1 in multiple pile holes as shown in FIG. 4. These piles will carry the gravitational weight load of the unstable soil layer down to a deeper stable layer of soil resulting in greater stability of the upper soil layer.

For a permanent stabilization project FIG. 4 shows how modified rebar 1 in grouted 8 holes 17 can be configured to modify the existing soil into the equivalent of a gravity retaining wall. This is accomplished by tying the piles together with a concrete slab 23 at the top of the proposed wall prior to making the vertical or near vertical cut. Then the upper portion of soil 10 is now functioning as a single mass where the driving force on the potential failure planes of weakness have been greatly reduced or eliminated. For this method to work the load created by the excavation needs to be absorbed by the upper section of the piles and transferred to stable ground at a lower elevation.

Figure 6:
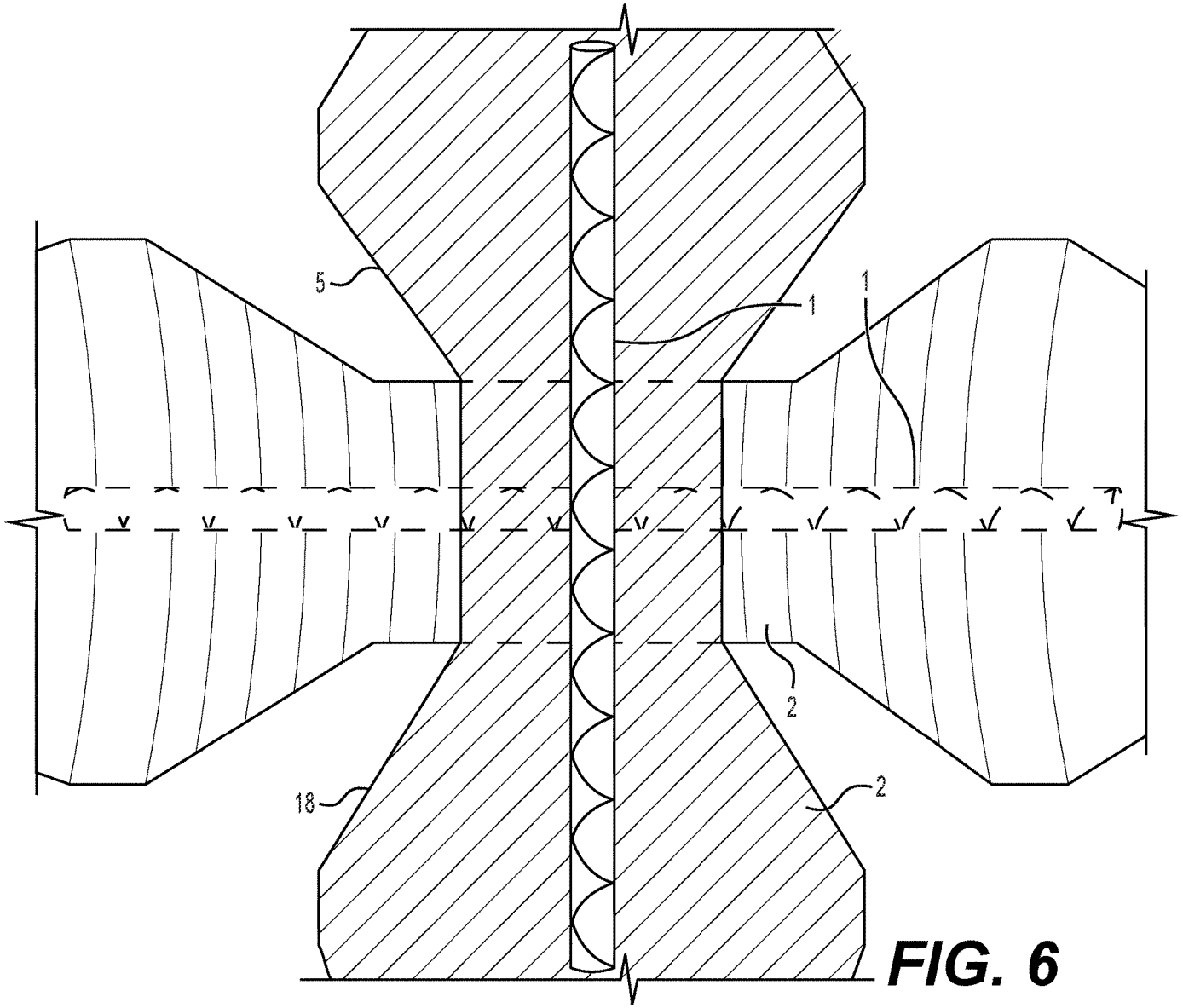
FIG. 6 Cut close view of multiple modified rebar for construction of the frame system shown in FIG. 5.
Figure 7:
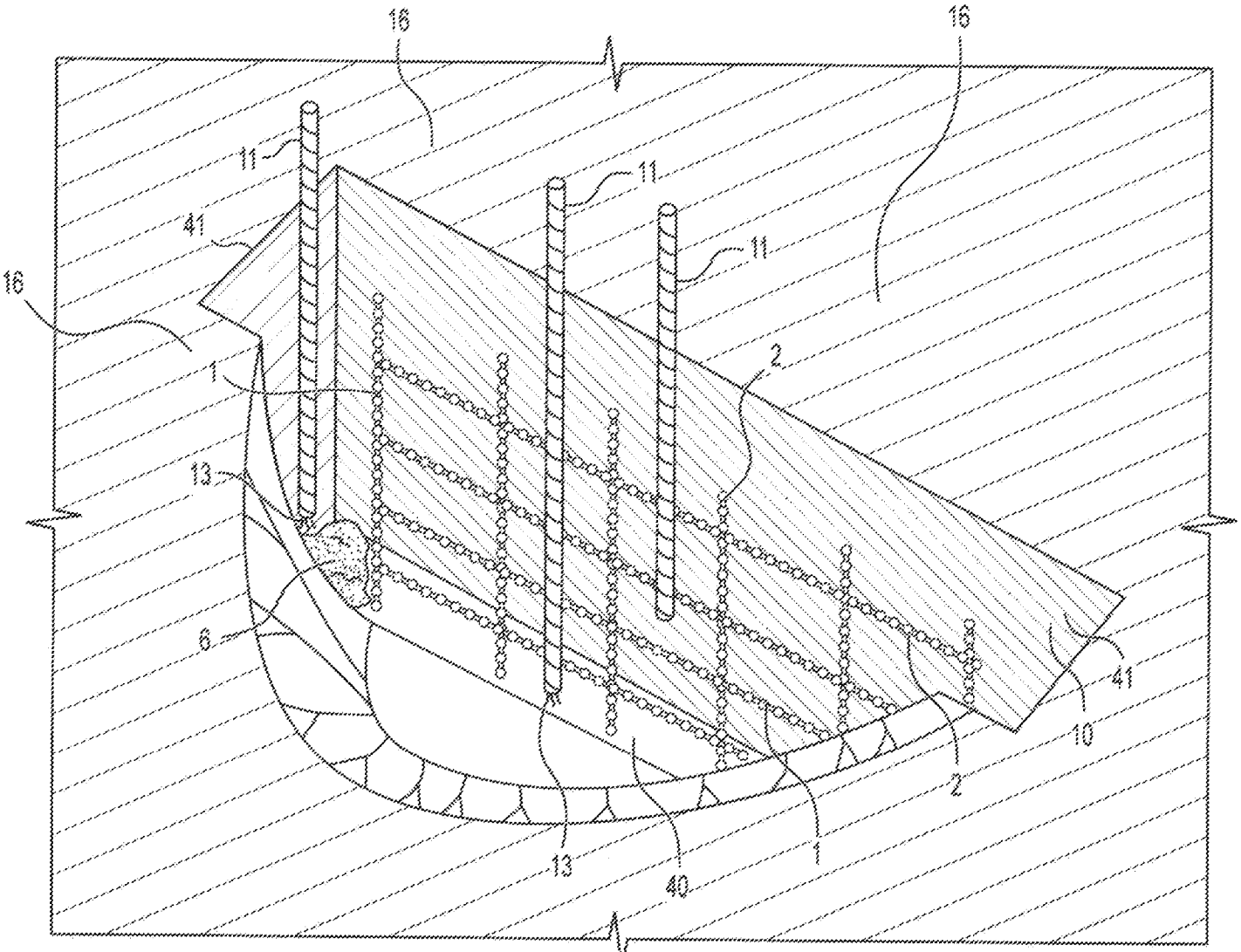
FIG. 7 Cut view of a modified rebar frame in a trench in existing soil that will be filled with granular material and grouted.
Figure 8:
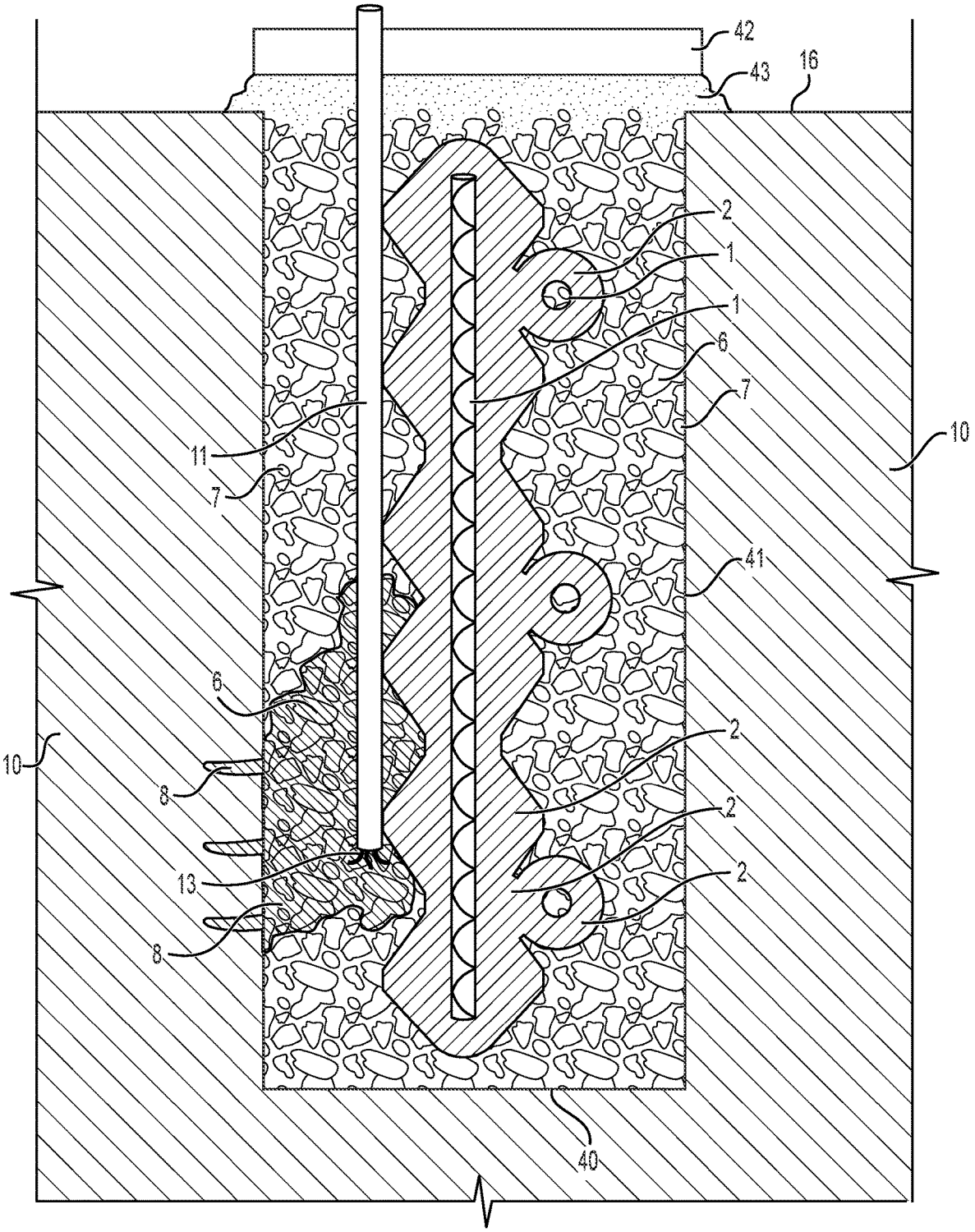
FIG. 8 Presents a cross section cut view of the same FIG. 7 trench backfilled with granular material and is being grouted.

Another use for the modified rebar 1 with its undulating concrete 2 cover is presented on FIG. 5, FIG. 6, FIG. 7, and FIG. 8. Here the modified rebars 1 with concrete 2 cover are grouped horizontally and vertically as presented on FIG. 5 to form a steel reinforced latus. FIG. 6 provides a close view of the ties between the intersecting modified rebar 1 which have been molded in concrete 2 separately and joined just prior to being placed into use. Another option would be to first tie the rebar in the desired pattern and then have the concrete molded on as a unit, however this would result in a very heavy and bulky unit. FIG. 7 shows how this latus has been placed into a trench. Then the trench is backfilled to or close to the original ground surface with granular fill and grout pipes. Then the fill mass around the modified rebar 1 latus can be grouted using the grout pipes 11 that were placed along with the fill. The fill mass could include cobble and boulder size material, or even demolition material. These would be placed in a matrix of sand 7 and gravel 6. It is this granular soil and large size fill matrix that will be grouted into a solid mass. This solid mass is held together by the modified rebar 1 latus which will carry tensile load and hold the entire mass together as a single unit. Load is then transferred from the surrounding soil 10 through the grouted fill mass to the undulating concrete 2 to the rebar 1. FIG. 8 shows how using pressure or expansive grout will result in the grout 8 penetrating the soil 10 to improve the load transfer. This is essentially how steel reinforced concrete works. The difference with this is the overall load is small enough that the strength of concrete is only needed around and along the steel rebars 1 of the latus.

Figure 9:
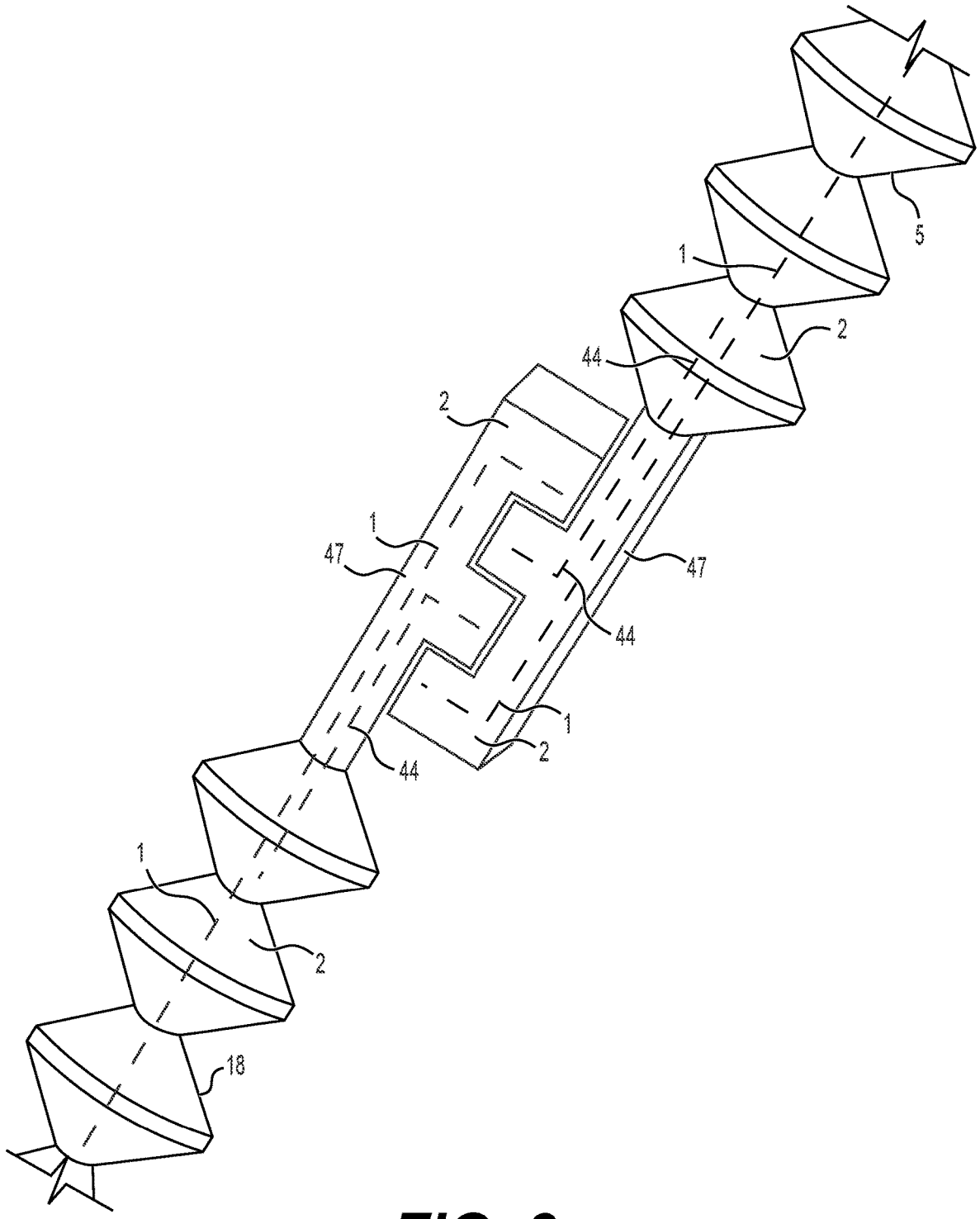
FIG. 9 Perspective view of two modified rebars being joined using a concrete interlocking molded system.
Figure 10:
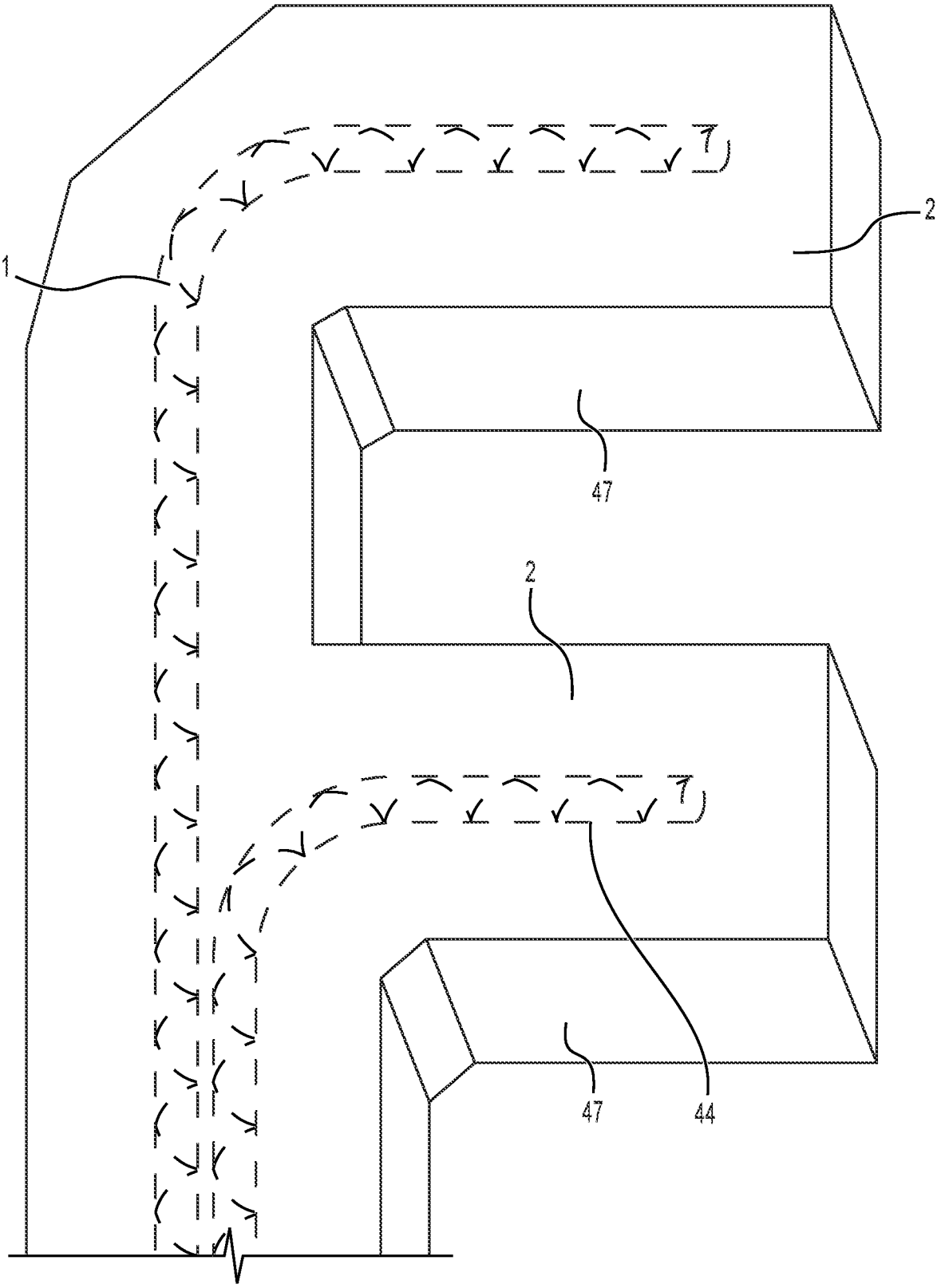
FIG. 10 Perspective close view of one of the interlocking molded rebar ends shown in FIG. 9.
Figure 11:
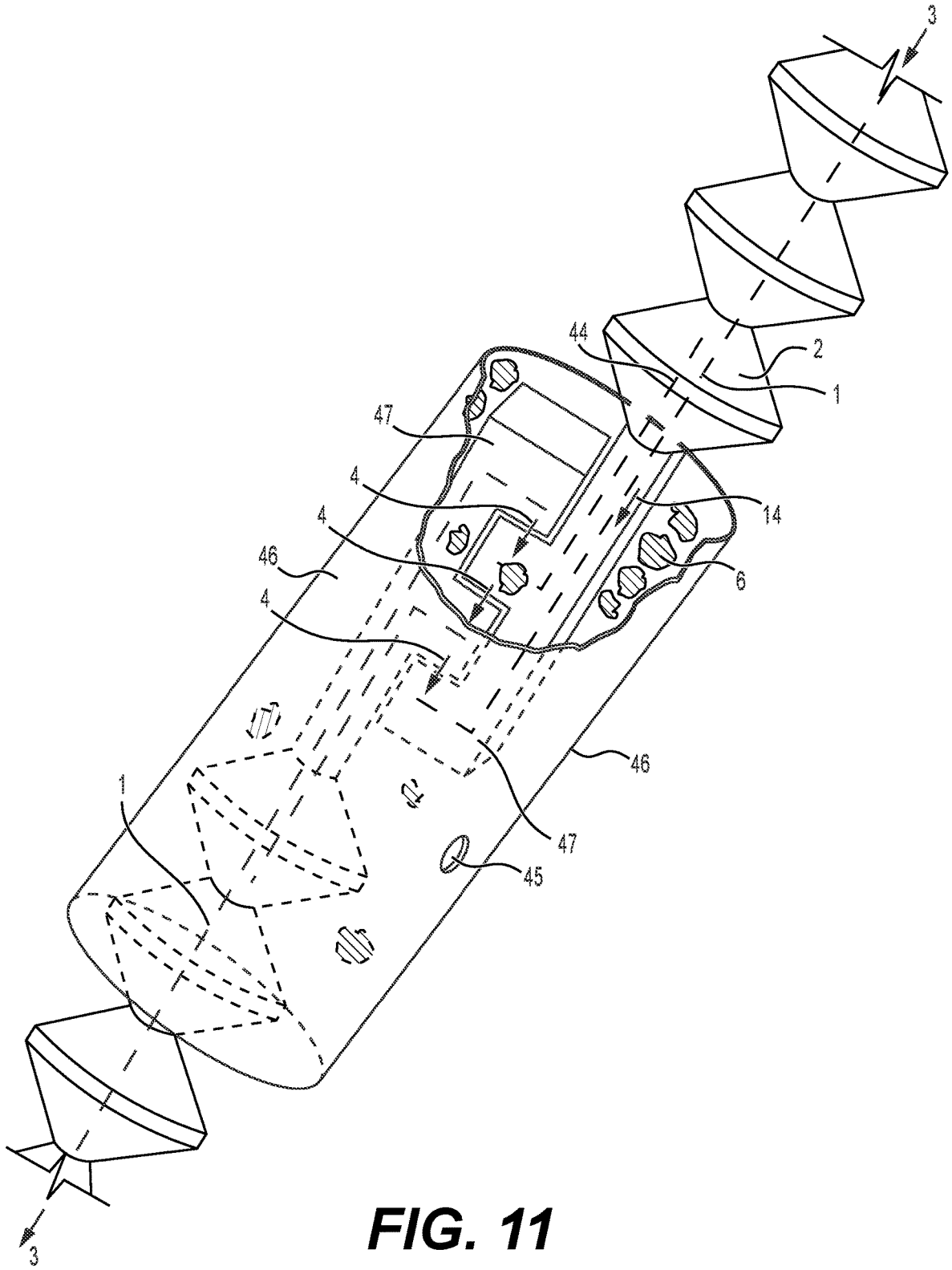
FIG. 11 Perspective cut view of the method to join two modified rebar inside a sleeve with gravel and a grout hole to lock the connection.

FIG. 9 shows the condition where the load needs to be transmitted beyond the length of one rebar and therefore, two concrete coated rebars can be tied structurally together. This can be done by molding an interlocking shape to the end of the rebar such that when two rebars 1 meet they will be locked together. This is a more efficient method than the typical system of overlapping the bars by a predetermined number of bar diameters. FIG. 10 presents a perspective view of just one end. In this embodiment it shows an end with two rebars and two concrete fingers. Depending upon loading conditions more similar fingers may be required. To ensure that the fingers have the necessary load capacity short sections of secondary rebar 44 needs to be structurally tied or welded to the primary rebar 1 so they can transmit a portion of the overall load. To keep the fingers of each rebar permanently in contact with their counterpart FIG. 11 shows a perspective view of a completed connection inside of a tube 46. The drawing includes a cut-away of the tube to expose the inner workings of the system. The annular space is filled with granular material that is then grouted through the grout port 45 to make a permanent connection.

Figure 12:
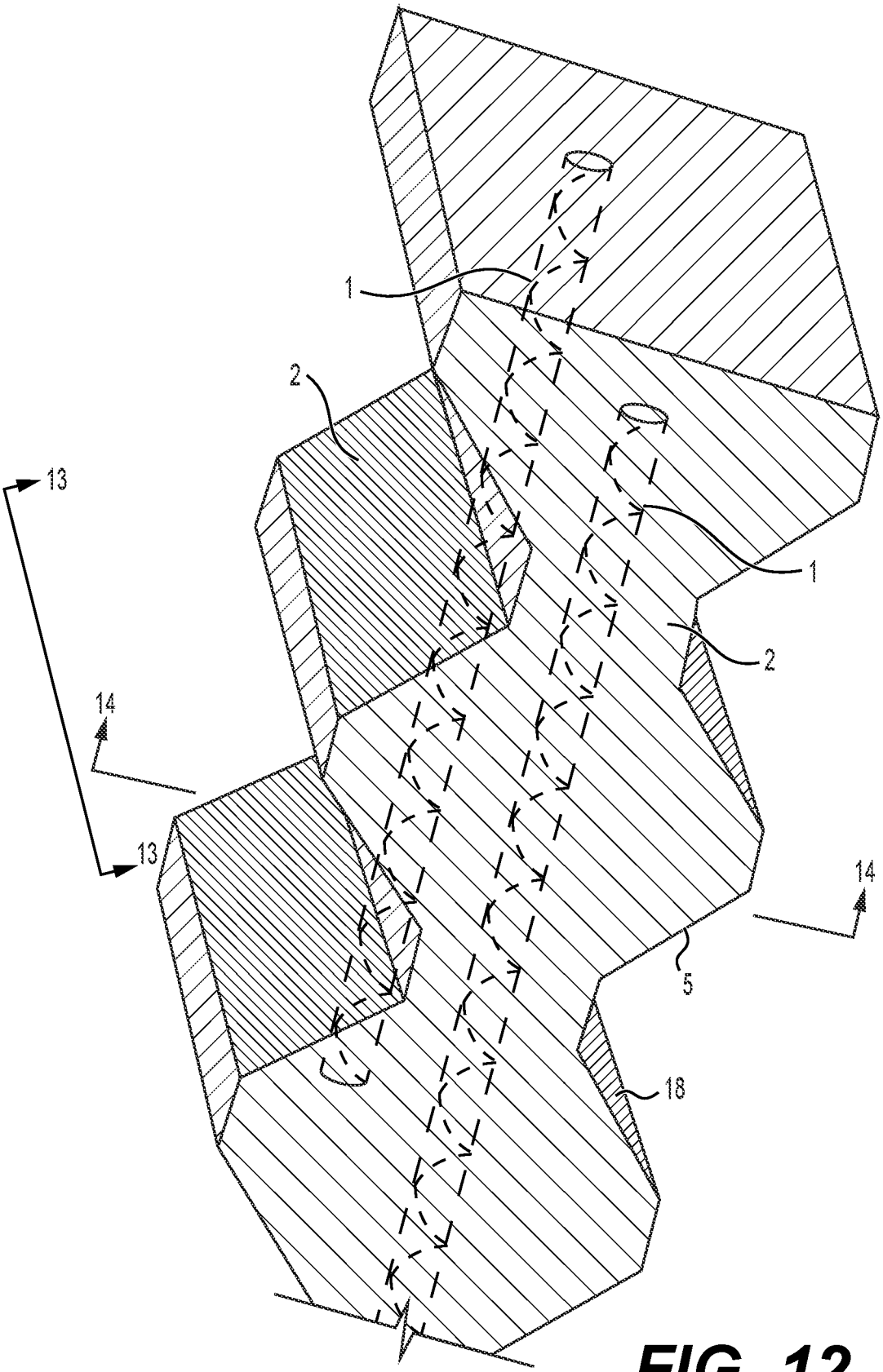
FIG. 12 Perspective of two rebar that are contained within one concrete molded undulating cover, and orientation of two additional views.
Figure 13:
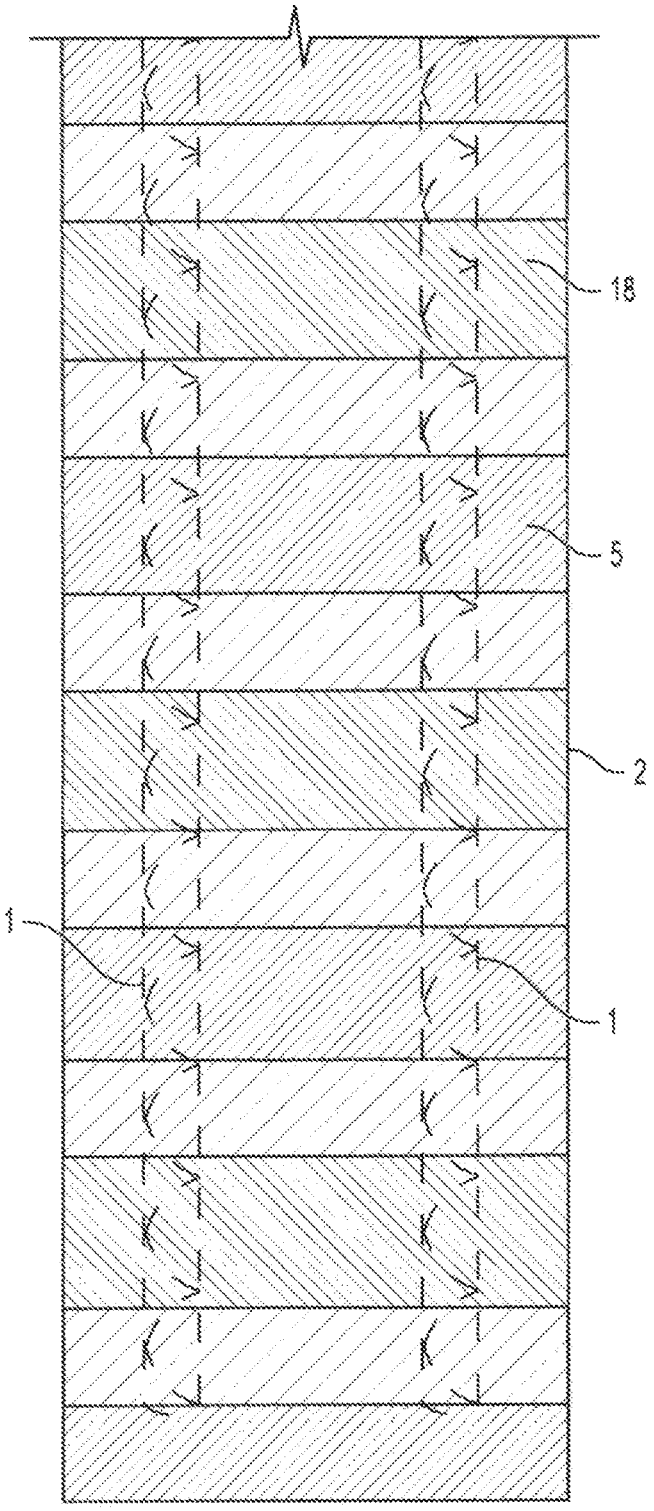
FIG. 13 Front view of the two rebar inside an undulating concrete mold looking directly at the undulating side.
Figure 14:
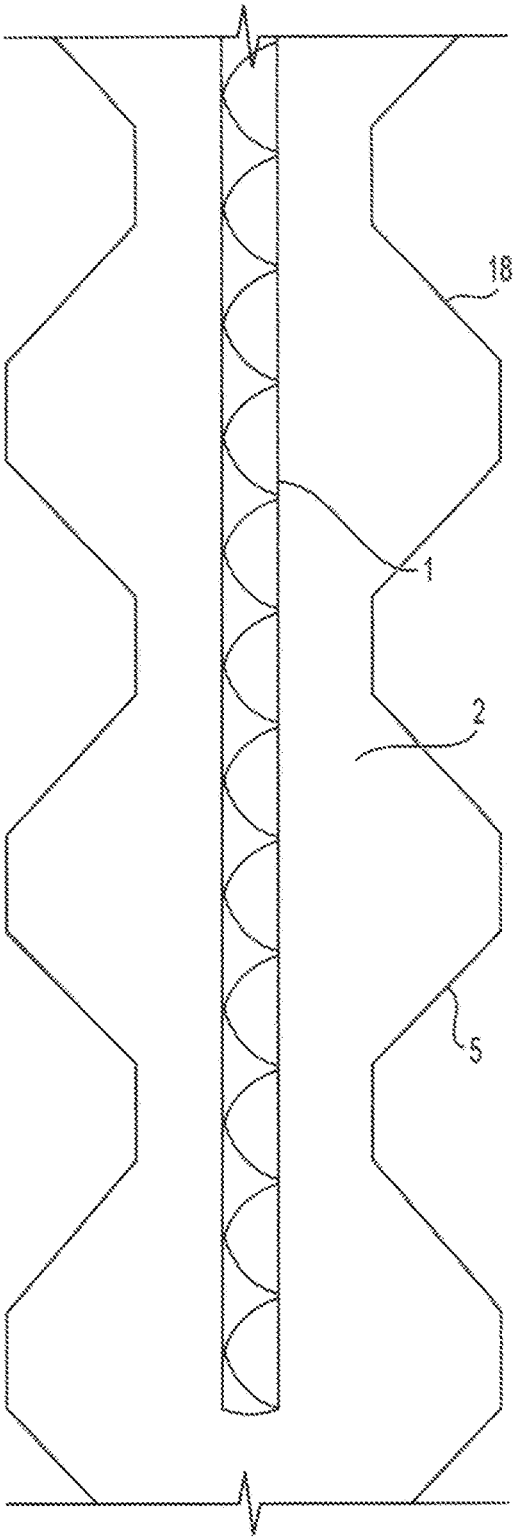
FIG. 14 Cut view of the same two rebar system showing the undulations where the back rebar is not shown because the back rebar is directly behind the front rebar.

It is possible to place more than one rebar 1 inside an undulating concrete 2 mold. FIG. 12 shows a perspective of the undulating concrete with two rebar 1 inside. FIG. 12 also shows the orientation of two sections views of the same undulating concrete with rebar. FIG. 13 shows both rebars exposed in a cut section. FIG. 14 shows the same undulating concrete from a cut that exposes one of the rebars. The orientation of the cut is looking head on at the front rebar which in turn covers second rebar which is directly behind the front rebar.

Figure 15:
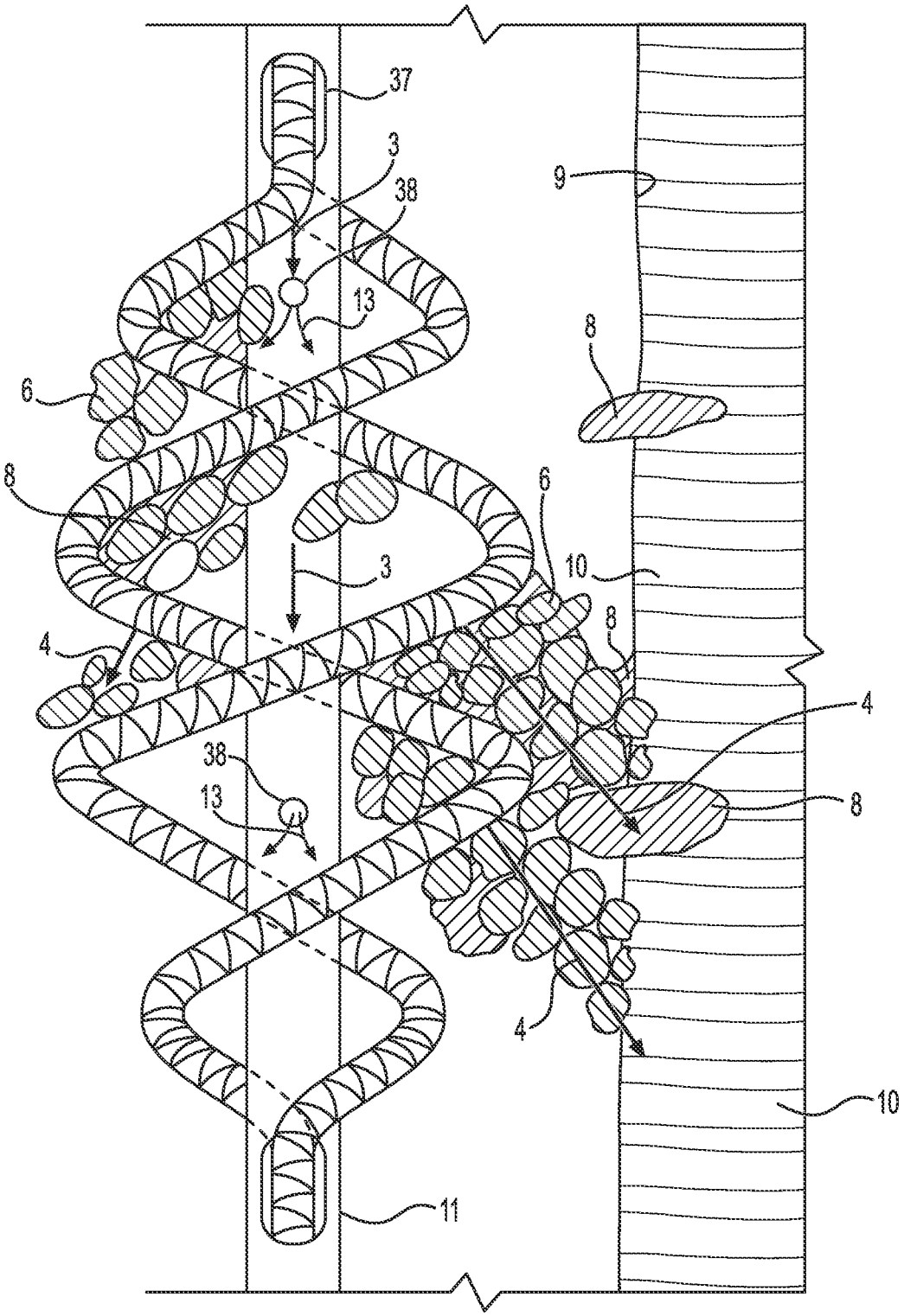
FIG. 15 Cut view of plurality of bent spiral rebars welded to a central grout pipe forming a node to improve load transfer to the soil.
Figure 16:
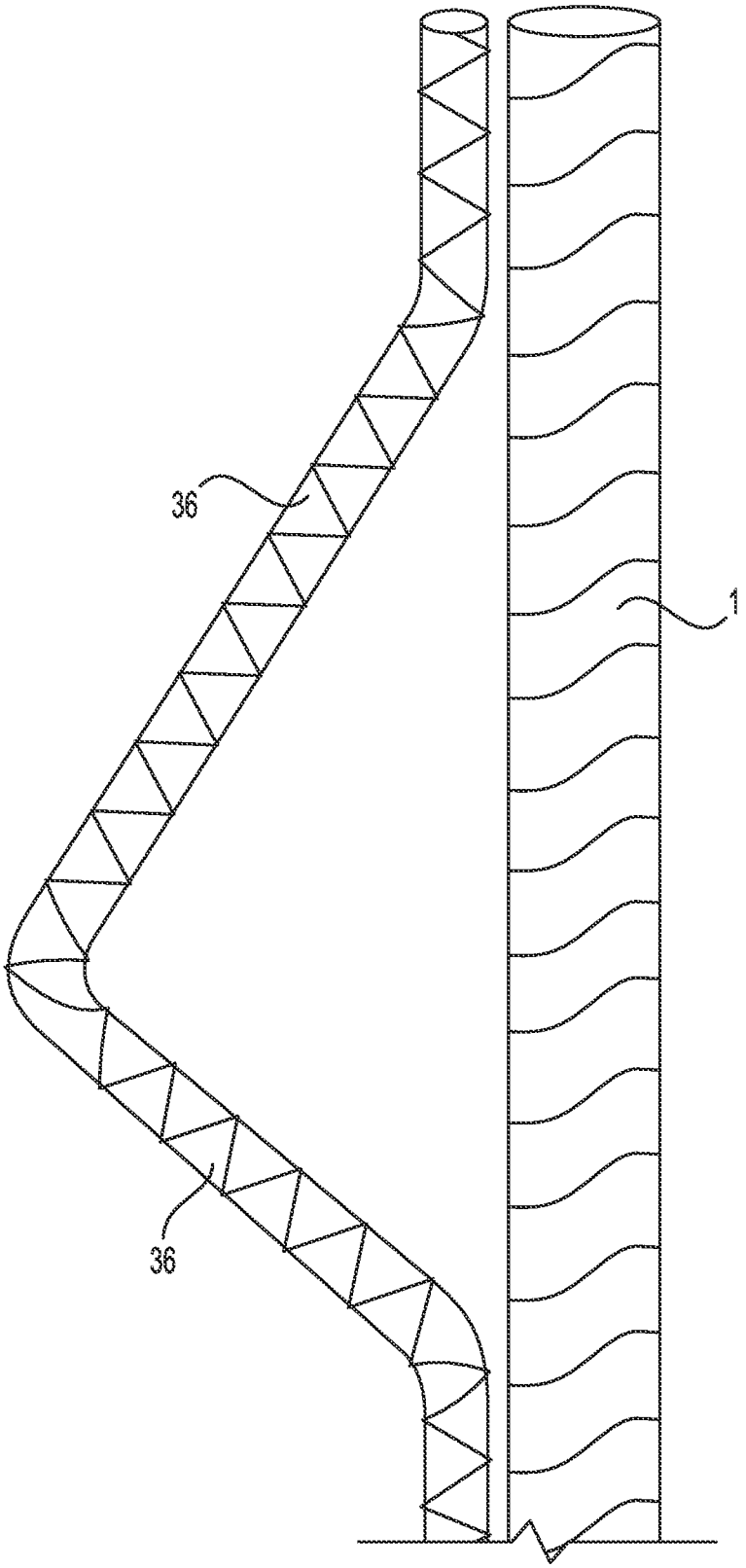
FIG. 16 Presents a bent small diameter rebar prior to being welded to a central load bearing rebar.
Figure 17:
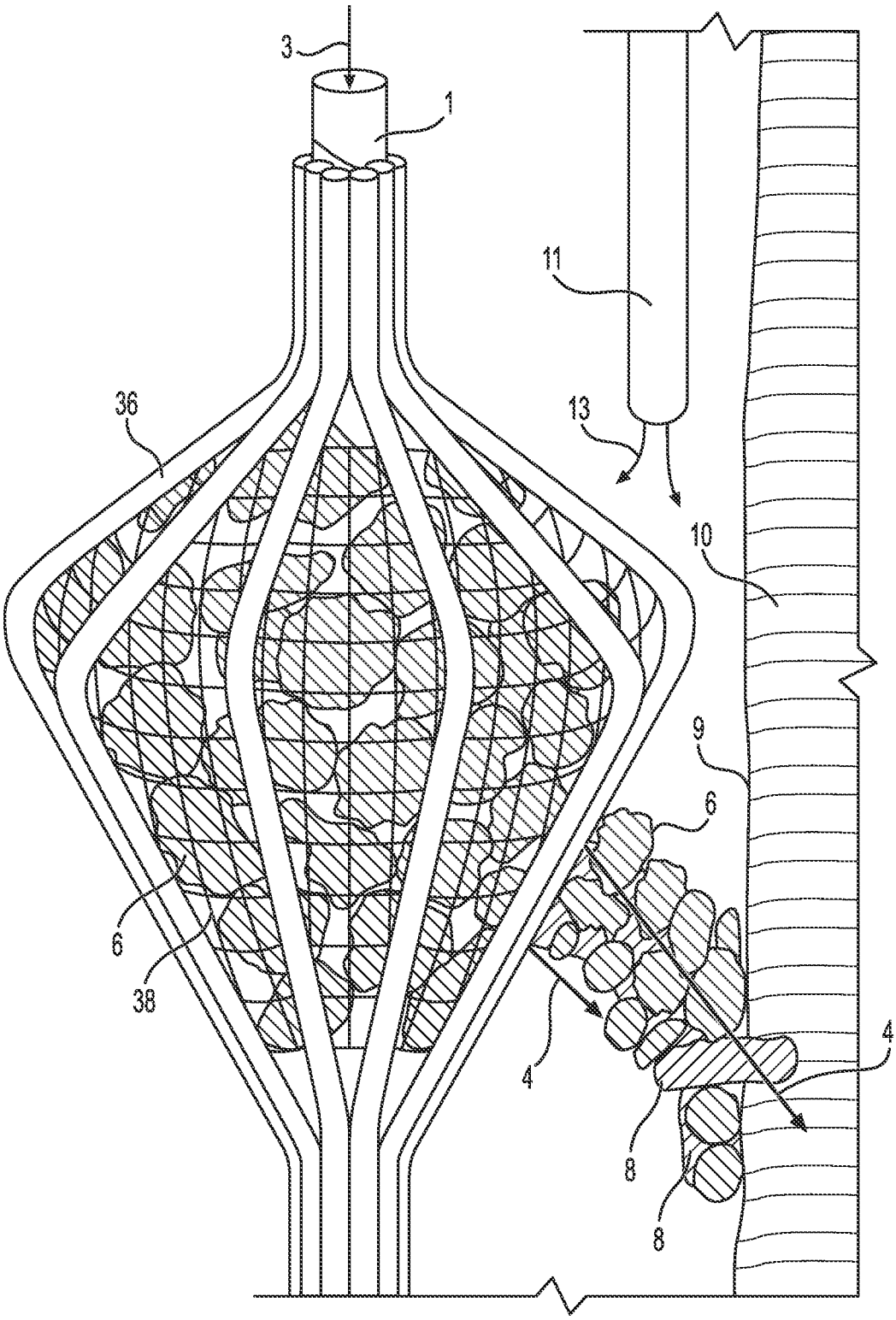
FIG. 17 Presents a completed load bearing central pipe with grout ports with a group of rebars similar to the bent rebar presented in FIG. 16.

For the purpose of making a load transfer system it is not necessary to use concrete nodes on the rebar. Where the corrosion of the rebar is not a concern then the nodes could be fashioned by making spiral shaped rebar around the central load bearing steel. FIG. 15 shows spiral rebar welded to a central tube. The central tube could be used to transmit the grout 13 through grout holes 38. Also, the tube could transmit and transfer the load 3 to the spiral shaped rebar where they are welded 37 to the central tube. The load would be transferred from the spiral rebar to the grouted gravel 6 and then to the surrounding soils 10 along a path shown as the arrow 4. Again, the load transfer is improved by the solidified grout 8 where it has penetrated the soil 10. Another method simpler than spiral shaped nodes is bent small diameter rebar 36 laid alongside the load bearing rebar 1 as shown on FIG. 16. When grouped together they form a node as shown on FIG. 17. This figure shows a node where inside the rebar node is a net to hold the gravel 6 inside the node. As with the other nodes the remainder of the fill is held in-place by grout 13 delivered by grout tube 11. Finally load 3 is transferred to the node rebar 36 possibly by welding (not shown on this view) and ultimately through the gravel along the arrow 4.

The following provides a more in-depth description of the enclosed figures. These figures and the descriptions here in are intended to provide a novel approach to supporting structures or to transfer load from one zone of soil that needs support to a stable zone located close by. As with other existing methods this design relies upon steel rebar to carry most of the load. The difference with this approach is to use a minimal volume of concrete that can be applied any time prior to the use of the rebar 1. The advantage is that the grout can be applied at any time and if it has a short set time then it can be load tested quickly to ensure that it will function as designed. Which is significantly faster than when Portland cement concrete is used which typically develops the majority of its strength over a period of weeks.

DESCRIPTION OF FIGURES

FIG. 1

Shows the basic design for modifying steel reinforcing bars 1 by covering them first with concrete 2 with an undulating shape that is allowed to cure prior to being placed into service. Once it is placed into service, the primary load 3 is placed on the internal rebar 1 which then transmits load 3 to the cured concrete 2 along the rebar 1 which is shown as load 14. Then the load passes through the concrete 2 until all of the load 3 has passed out of the concrete as load 4 through the plurality sloping faces 5. It should be noted that the total surface area of sloping sides 5 are significantly larger than the cross-sectional area of the rebar 1. Therefore, the pressure of load 4 per square unit of area is proportionally less than the load 3 pressure per square unit of area on rebar 1. This is the explanation for why load 4 is significantly less per square unit of area than load 14 and then in turn the strength of the material beyond the concrete 2 can be proportionally less than the strength of concrete 2 and still adequately carry the total load 3 that was placed upon the rebar 1 at the top of the pile. Then in turn the cross-sectional area of the concrete 2 that is molded along the rebar is larger than the cross-sectional area of rebar 1 where load 3 is initially placed on rebar 1. Then in turn the per unit strength requirement of the material that load 4 is imparted to only needs to be a fraction of the per unit strength of the concrete 2. The reverse of this load transfer is also true. The load 19 pressure on to sloping surface 18 can be relatively small per square unit of area compared to the per unit load caring capacity of the concrete 2. The plurality of sloping surfaces 18 along the length of the pile will ultimately transfer all of the load to the concrete 2. Then the concrete 2 would transfer that load to the stiffer steel rebar 1 along the perimeter ribs shown as load 14 where it is being transferred from the concrete 2 to the steel rebar 1.

FIG. 2

This figure shows the basic design and operation of the modified rebar. This shows the undulating concrete 2 molded around two adjacent rebars 1. It should be noted that the modification claimed herein is not limited to concrete. Other variations not using concrete are covered later in this submittal. What is claimed is that it is necessary for the covering to have an undulating shape. As shown, where more than one rebar 1 is required the undulating concrete 2 shapes can be aligned out of phase to improve the connectivity. This configuration is also a way for two rebars 1 to be spliced together. The load 3 is delivered to the system through the top rebar 1. Said load is then transferred from the rebar 1 to the molded concrete 2 by friction 14 along the ribs of the rebar 1. Load is then transferred out of the molded concrete 2 primarily across the sloping face 5 of the undulation. The sloping face 5 will transfer the load to the adjacent material as load 4. The adjacent material may be another concrete 2 mold, gravel 6, sand 7, or solid hardened grout 8. The load passes through several mediums to reach the edge of the boring 9. At that point, like with all other cast in drill hole piles the load is transferred to the surrounding soil 10. Following the principle of physics, that the stiffest element carries the majority of the load. Then in the case beyond the concrete the stiffest material would be the densified gravel 6. The primary purpose of the sand 7 and solid grout 8 are to hold the gravel 6 in place. This is why the order of construction is important. First the modified rebars 1 are lowered into the hole along with the grout pipes, then the gravel 6 along with sand 7 is placed, saturated and vibrated into a dense configuration. This can be accomplished using a typical concrete vibrator 12. As the wet mix of sand 7 and gravel 6 become dense then the vibrator 12 is withdrawn. Then the liquid grout 13 is injected to lock the dense sand 7 and gravel 6 into place. Depending upon site conditions pipe 11 could be used to withdraw excess water from the boring, prior to the injection of grout. Because the boring is not lined or cased the grout 13 will seep out beyond the edge of the boring 9. The distance that the grout 13 travels into the soil 10 depends upon the pressure placed on the liquid grout 13 and the soil 10 condition. This will improve the contact and load transfer at the interface between the edge of boring 9 and the surrounding soil 10. Once the liquid grout 13 has flowed to its limit it will solidify into solid grout 8. This completes the pile construction for load transfer process from load 3 in the steel rebar 1 to the surrounding soil 10. As will be shown in additional figures it is possible to reverse this load transfer process from surrounding soil 10 that needs support. A significant portion of the weight of soil 10 can be transferred to rebar 1 which will carry it as load 3 to a depth where it can be transferred back to a deeper soil 10 layer that can provide support.

FIG. 3

This figure shows a completed pile drilled through the ground surface 16 that is subject to an external load 3. The grout pipes 11 are left behind after the piles has been completed. As shown the load is transferred from the rebar 1 to the concrete 2 along the ribs of the rebar 1 noted as load 14. From there it passes through the concrete 2 material of the node to the dense sand 7 and gravel 6, that is locked in place by the solid grout 8. This is shown by the arrows depicting load 4 where the sloping face 5 of the node is placing a compression load 4 on the dense sand 7 and gravel 6. The load then is delivered to the surrounding soil 10 which has been improved by the solid grout 8. Because the hole is unlined at the time that the liquid grout 13 is injected into the system it is free to flow into the weakest zones of the surrounding soil 10. This action of improving the weakest zones causes the overall strength of the surrounding soil 10 to be improved. As discussed above the weakest interface between a pile 17 and the supporting medium is at the edge of the pile 9. Leaving the pile unlined provides the greatest possibility that this interface will be improved and in turn load 15 will be increased over what could be imparted to the original soil 10 due to the increased capacity of grouted soil 10.

FIG. 4

This shows another use for this pile 17 system. Using multiple rows of piles 17 can result in the formation of a gravity retaining wall. Gravity walls are typically built from the bottom of a temporary excavation using select compacted fill with horizontal ties. That method uses the solid mass of the reinforced fill to hold the remaining soil in-place. The method proposed herein claims that by using numerous small piles 17 that provide vertical support to the existing soil 10 the soil closest to a proposed cut or retaining wall will function the same as a gravity wall. Thus, the soil 10 closest to the cut or wall that typically requires support is now self-supporting. The piles 17 have turned the problem into the solution. Given that these piles are not large enough to be soldier piles they do need to be tied together to function as a unit, but depending on conditions they can be tied together using slab 23. Given that the entire rebar 1 does not need to be covered with concrete 2 nodes makes it possible to use the upper part of the rebar 1 to tie the piles 17 together. This system of tying the piles 17 together could be either a concrete slab 23 or grade beams. The same slab 23 or grade beam system could also be used to help support the wall face 25 by tying the wall rebar 1 to the pile 17 rebar 1. With the soil 10 now becoming a self-supporting mass the wall 25 only needs to provide erosion control. Also, the wall 25 needs to support the sand 7 fill above the back drain 26.

FIG. 5

This figure shows grid of assembled concrete 2 coated steel rebars both vertical rebar 1 and horizontal rebar 1 tied together with wire ties. In this view the vertical bars 1 are in front and view cut is through the middle of the concrete 2 to expose the vertical rebars 1, with the cut exposing the interior of the molded concrete 2. The horizontal bars 1 are shown behind the vertical bars with the outer shape of the molded concrete shown and the rebars 1 are shown inside the molded concrete. The sloping surfaces 5 and 18 are noted on the drawing and exist throughout both the vertical and horizontal components of the grid. An enlarged view FIG. 6 is noted on the FIG. 5.

FIG. 6

This figure shows the intersection of the vertical rebars 1 exposed inside the molded concrete 2 along with the horizontal rebars 1 passing behind. Not shown a tie at that intersection because any tie method will work and is only needed temporarily until the excavation is filled and permanently grouted. The sloping surfaces 5 and 18 of the molded concrete 2 are identified.

FIG. 7

This figure shows a cutaway view of a trench 40 being excavated into native soil 10 being prepared for grouting. The steel reinforced grid with both the vertical rebar 1 and the horizontal rebars 1 all covered with the molded concrete 2 has been installed into the center of the trench 40. The sides of the trench 41 and trench bottom 40 are shown along with the surrounding surface 16. Also shown are the grout pipes 11 above the newly placed course grained gravel 6 fill. Once the trench is properly filled then the excavation is stable and can be grouted with liquid grout 13 under pressure at any time.

FIG. 8

This view shows a vertical cut through a trench that has been properly backfilled to the level of the adjacent ground surface 16 and is in the beginning stages of grouting. The liquid grout 13 is coming out the end of the grout pipe 11. Later the grout 8 will harden locking the sand 7 and gravel 6 fill in place. The final result is a buried steel reinforced wall. In addition, the grout 8 can penetrate the surrounding soil 10 to improve the soil and the soil connection beyond the sides 41 of the trench. The vertical cut exposes the vertical steel rebar 1 and the ends of the horizontal rebars 1. Both the vertical and horizontal rebars 1 are coated with undulating Portland cement concrete 2 to protect the rebar, therefore, the modified rebars 1 can be set on the bottom of the trench 40. If expansive grout 13 or grout 13 is injected under pressure then the grout will penetrate beyond the trench walls 41 thus it will make a better load transfer connection to the surrounding soil 10. For pressure grouting the top of the trench would need a heavy temporary weight such as fill 43 or concrete slab 42 to provide temporary confinement.

FIG. 9

In this embodiment two modified concrete 2 covered rebars 1 are joined end to end using a specific shape molded at the end of each rebar so that the two modified rebar 1 will interlock. This perspective drawing shows the far end of each rebar 1 as being similar to the design presented in FIG. 1. The primary difference is near the end of each modified rebar. Near the end a secondary rebar 44 is included in the middle of the concrete 2 molded section. As shown the rebar 44 is at the first finger of interlocking connector 47. This provides additional strength to the first molded finger and allows the load from that finger to be efficiently transferred to the primary load carrying rebar 1. The rebar 1 then proceeds to reinforce the end concrete 2 finger of the connector 47. Given that both connectors 47 are mirror images of each other the above description applies to each modified concrete 2 covered rebar 1. If the loading conditions require additional fingers and secondary rebar 44 could be added to make a stronger connection.

FIG. 10

This figure shows a partial enlarged section of one connector 47 with the rebar 1 and rebar 44 inside the molded concrete 2. The primary limitation on the size of the connector 47 is that at all points the rebars will need a minimum of 1.5 inches of concrete 2 cover to protect them from corrosion.

FIG. 11

This embodiment of the interlocking connectors 47 is similar to the embodiment shown in FIG. 9 with the addition of confinement tube 46. The confinement tube 46 needs a minimum inside diameter large enough to contain both interlocking connectors 47. In this embodiment the remaining annular space is filled with gravel 6 which will be grouted through the grout port 45. The load arrows 14 show how the load 3 is transmitted to the concrete 2 and ultimately from one set of connectors 47 fingers the load 4 is transmitted to the fingers of the receiving connector 47. Thus the load 3 is efficiently transmitted from one rebar 1 to the next rebar 1.

FIG. 12.

This is a perspective view of two rebars 1 where the undulating surface of the concrete only occurs on two surfaces 5 and 18. The concrete 2 is flat on the other two sides. The purpose of this embodiment is to provide additional moment and shear load capacity. Two sections are noted and will be presented on FIG. 13 and FIG. 14.

FIG. 13

Presents a front view of the two rebars 1 inside an undulating concrete 2 mold looking at the undulating side. In this view both rebars 1 are shown inside the molded concrete 2. The up facing slopes 18 are also shown along with the down facing slopes 5.

FIG. 14

Presents a cut view of the same two rebar 1 system showing the undulations and it should be noted that the back rebar 1 is not shown because it is directly behind the front rebar 1. Again the up sloping surface 18 and down sloping surface 5 are shown which form the undulations of the molded concrete 2.

FIG. 15

This presents a different method of creating a node that is not made from concrete 2 along a rebar 1. As shown the center rebar has been replaced with an injection pipe 11. Two or more small rebar 36 are bent to form a spiral around the center pipe 11. These small rebar 36 are attached to the pipe 11 by welding 37. In this embodiment the grout pipe 11 serves two purposes. First, it is the method of providing water or grout and with multiple injection holes 38 that can be closed off using a method known as a tube-a manchette system. Second the pipe 11 is sufficient to support axel load 3. The load 3 is transferred to the small bent rebar 36 through the weld 37. The spiral shape is filled with gravel 6 which extends beyond the spiral bent rebar 36. The gravel 6 is densified and locked into place by the solid grout 8 that was originally injected as liquid grout 13 into the pile through the injection hole 38. Again, the slope of the bends in the small rebar 36 impart a portion of the original load 3 to the gravel 6 in the form of a compression load 4. The grouted 8 gravel 6 transmits the compression load 4 through the gravel 6 to the surrounding soil 10. The interface along edge of the drilled hole 9 is improved by the gravel 6 being densified and pushed into the surrounding soil 10. What is claimed herein is that all of the load transfer systems described in FIGS. 1 through 10 can also be done using the spiral rebar 36 and the modified injection pipe 11.

FIG. 16

This figure shows two rebars. One is a strait rebar 1 and the second is a smaller bent rebar 36. The purpose of this figure is to show how a node can be made using standard rebars. The node requires several of these bent rebars 36 attached to the straight rebar 1. If the attachment is done by welding, then the strength of the strait rebar 1 may be reduced. However, analyses should be performed to determine how much load an individual node would be transferred from rebar 1 to the soil 10.

FIG. 17

This figure shows a group of small bent rebar 36 form a node around the primary rebar 1. This system would have a node filled with gravel 6 which are held in place by a screen. Similar to the previous node systems described in FIGS. 1 through 10 this node would be held in place by grout 8. The load 3 is transferred from the main rebar 1 to the smaller bent rebar 36. The rebar 36 transfers the load to both the rebar 36 inside the node and the pile 17 rebar 36 fill. The load is disseminated through the gravel 6 to the soil 10. The load transfer is improved by the densified gravel 6 pressed into the soil 10 and possible grout 8 intrusion into the soil 10. What is claimed herein is that all of the load transfer systems described in FIGS. 1 through 10 can also be done using the bent rebar 36 system to form a node.

The invention claimed is:

1. A method for constructing steel reinforced structural elements consisting of first modifying steel rebars by placing concrete on said rebars and allowing the concrete to cure prior to placing the modified rebars into service in an excavation or confined space; wherein said rebars with the cured concrete have undulating shape that alternates from a minimum covered zone that transitions to a maximum covered zone which transitions back to a minimum covered zone with said undulations repeating along a length of the rebars and leaving a portion of said rebars unmodified; the minimum covered zone has a concrete cover thickness of at least 1.5 inches and the maximum covered zone has a concrete cover that is at least 1.5 times of the thickness of the concrete cover of the minimum cover zone, and the transition between the minimum and maximum covered zone has a slope at an angle between 20 and 45 degrees as measured from an alignment of the rebar within the concrete; prior to placing the modified rebars into service, the concrete is allowed to cure to a minimum unconfined compressive strength of 2000 pounds per square inch (PSI) then said modified rebar may be placed into service; wherein the second step of constructing the structural elements is to place the modified rebar in the excavation or other confined space and then surrounding the modified rebar with granular fill material to completely fill a space between the modified rebars and the limits of the excavation or confined space, the granular fill consisting of sand, gravel, cobbles, boulders, and possibly demolition concrete or slag from metal refining to completely fill the space between the modified rebars and the excavation or other confined space prior to grouting, then to complete the structural elements the modified rebars include a grouting system to grout the entire surrounding space to ensure that the granular fill and the modified rebar will function as a complete structural element; and connecting the unmodified portion of the rebars with other structures including at least one of a pile cap, grade beam, structural foundations, structural slabs, walls, columns, or tie back anchors.

2. The method of claim 1 wherein said modified rebars, granular fill, and the grouting system consisting of pipes spaced to ensure uniform grouting.

3. The method of claim 1, wherein the concrete cover includes the undulating shape on a portion of the modified rebars.

4. The method of claim 1, wherein a concrete form is placed in the excavation or confined space first and then said modified rebars are placed in the excavation and then Portland cement concrete is then poured around the modified rebars.

5. The method of claim 1, wherein the grout system is lowered into the excavation along with the modified rebars then the remainder of the hole is filled with granular fill which is then grouted by pumping grout through the grout pipes using fast setting polymer, or other grout capable of locking the granular fill in-place.

6. The method of claim 2, wherein the structural elements are comprised of multiple modified rebars tied in two directions to form a lattice.

7. The method of claim 1, wherein splicing modified steel rebars where it is necessary, the unmodified portion of each modified rebar may be joined to the next modified rebar by casting unmodified end portions of each of the rebars with concrete in shapes that allow for the ends of each modified rebar to interlock with the next modified rebar with minimum overlap, this can be accomplished through the use of additional rebars spliced alongside a load bearing rebar and cast together in concrete in the undulations leading up to the splicing end of the modified rebar thus making it possible for multiple rebars to be formed into multiple interlocking fingers at the end of the first rebar such that the next rebar which has been cast with a complementary set of molded fingers designed to fit snugly into the spaces between the fingers of the first rebar and in the case of each rebar prior to casting the ends, the rebars are bent around a tight curve as determined by the diameter size of bar and anticipated load at a connecting point, to ensure that the fingers of each rebar will remain in close contact with the fingers of the next rebar then the two concrete covered rebars shall be enclosed in a containment vessel such that any remaining void space can be grouted to hold the ends in-place so that the load on the first rebar can be efficiently transmitted to the second rebar.

* * * * *